US008555442B2

(12) United States Patent
Liu et al.

(10) Patent No.: US 8,555,442 B2
(45) Date of Patent: Oct. 15, 2013

(54) TRANSPORTATION AND ERECTION INTEGRATED MACHINE WITH DISPLACEMENT PLATFORMS AND METHODS FOR ERECTING BRIDGE USING THE SAME

(75) Inventors: Yabin Liu, Beijing (CN); Shengjun Zhang, Beijing (CN); Da Pan, Beijing (CN); Fude Zhang, Beijing (CN)

(73) Assignee: Beijing Wowjoint Machinery Co. (CN)

( * ) Notice: Subject to any disclaimer, the term of this patent is extended or adjusted under 35 U.S.C. 154(b) by 0 days.

(21) Appl. No.: 13/640,669

(22) PCT Filed: Mar. 28, 2011

(86) PCT No.: PCT/CN2011/000528

§ 371 (c)(1),
(2), (4) Date: Nov. 14, 2012

(87) PCT Pub. No.: WO2011/143923

PCT Pub. Date: Nov. 24, 2011

(65) Prior Publication Data

US 2013/0055512 A1 Mar. 7, 2013

(30) Foreign Application Priority Data

May 19, 2010 (CN) ..... 2010 1 0185308

(51) Int. Cl.
*E01D 21/06* (2006.01)

(52) U.S. Cl.
USPC ..... 14/2.5; 14/77.1

(58) Field of Classification Search
USPC ..... 14/2.4, 2.5, 77.1
IPC ..... E01D 21/06
See application file for complete search history.

(56) References Cited

U.S. PATENT DOCUMENTS 3,027,633 A * 4/1962 Murphy ..... 14/4
3,299,191 A * 1/1967 Mantscheff et al. ..... 264/34

(Continued)

FOREIGN PATENT DOCUMENTS

CN 2767494 Y 3/2006
CN 101793007 A 8/2010

(Continued)

OTHER PUBLICATIONS

"International Application Serial No. PCT/CN2011/000528, International Search Report mailed Jul. 7, 2011", 4 pgs.

*Primary Examiner* — Gary Hartmann
(74) *Attorney, Agent, or Firm* — Schwegman Lundberg & Woessner, P.A.

(57) ABSTRACT

The invention provides a special launching carrier with variable position platform and a method for bridge erection using the same. The special launching carrier with variable position platform comprises a special carrier for erection bridge beam and an under-bridge machine with platform. The special carrier for erecting beam comprises a main beam, a front wheel group, a rear wheel group and a lifting device; the under-bridge machine with platform comprises a under-bridge, a rotatable rear leg, a front roller, a middle roller, a rear roller and an erecting trolley arranged on the under-bridge, and the variable position platforms are installed on both sides of tail portion of the under-bridge. When erecting bridge beam, the front wheel group moves onto the variable position platforms, which may be elevated and folded in terms of conditions of the first and last spans of different bridges, so that the bridge erection is achieved.

7 Claims, 19 Drawing Sheets

(56) References Cited

U.S. PATENT DOCUMENTS

| | | | | |
|---|---|---|---|---|
| 3,571,835 | A * | 3/1971 | Buechler | 14/77.1 |
| 5,511,268 | A * | 4/1996 | Albus et al. | 14/77.1 |
| 6,918,152 | B2 * | 7/2005 | Fuessinger et al. | 14/77.1 |
| 8,065,769 | B2 * | 11/2011 | Krimpen et al. | 14/2.5 |

FOREIGN PATENT DOCUMENTS

| | | | |
|---|---|---|---|
| CN | 201770947 | U | 3/2011 |
| CN | 202187297 | U | 4/2012 |
| JP | 2005-155160 | A | 6/2005 |
| JP | 2006-028881 | A | 2/2006 |

* cited by examiner

TRANSPORTATION AND ERECTION INTEGRATED MACHINE WITH DISPLACEMENT PLATFORMS AND METHODS FOR ERECTING BRIDGE USING THE SAME

RELATED APPLICATIONS

This application is a nationalization under 35 U.S.C. 371 of PCT/CN2011/000528, filed Mar. 28, 2011, and published as WO 2011/143923 A1, on Nov. 24, 2011, which claims priority to Chinese patent Application Serial No. 201010185308.X, filed May 19, 2010, which applications and publications are incorporated herein by reference in their entirety.

TECHNICAL FIELD

This invention relates to a special launching carrier with variable position platform and a method for bridge erection using the same.

BACKGROUNDS

Currently, the existing special launching carrier with under-bridge, such as the one disclosed in Chinese patent document No. ZL200420115944.4, may have the problem with erection for first span at the entrance and exit of a tunnel or erection for a short bridge (less than three spans) between two tunnels. It is due to the fact that the size overlaid is larger than the size of cross section of the tunnel and the horizontal height of a under-bridge differs from that of a bridge abutment when a special carrier for erecting beam and an under-bridge machine with platform are utilized for bridge erection, which makes it difficult to erect the first or the last span of an entire bridge, and also affect the stability of operation of the system and the safety of construction. This invention will provide a special launching carrier with variable position platform for solving the above problems.

SUMMARY OF THE INVENTION

In order to solve one problem mentioned, the invention provides a special launching carrier with variable position platform that may facilitate the erection of the first span of an entire bridge at the entrance and exit of a tunnel or a short bridge between two tunnels, in the circumstance that an entire bridge comprises less than three spans, which may realize high stability of operation and high effectiveness of erection. The invention further provides a method for bridge erection using the system.

In this invention, a special launching carrier with variable position platform, comprising:

a special carrier for erecting beam and an under-bridge machine with platform;

wherein, the special carrier for erecting beam comprises a main beam, on which a lifting device is disposed; a front wheel group and a rear wheel group respectively connected with and disposed under the main beam;

the under-bridge machine with platform comprises a under-bridge, and also comprises a front roller, a middle roller and a rear roller, disposed for supporting the under-bridge and operable to move along the under-bridge through the rollers, and the under-bridge machine with platform further comprises an erecting trolley;

the system further comprises a rotatable rear leg connected with and disposed under the under-bridge, the rotatable rear leg and the under-bridge are operable to be on the same line or perpendicular with each other by rotating rotatable rear leg backward and outward; and the rotatable rear leg, the front roller, the middle roller, and the rear roller respectively has a height regulating device installed thereon, in order to ensure an appropriate horizontal height of the under-bridge; and a set of foldable and elevatable variable position platforms installed on both sides of the tail portion of the under-bridge, which allow the front wheel group to move from abutment or bridge onto the under-bridge smoothly.

The horizontal height of the under-bridge is regulated by altering the lengths of the rotatable rear leg, the front roller, the middle roller and the rear roller with the height regulating device.

The height of a connection part of the erecting trolley, which is for connecting with and the special carrier for erecting beam, is regulatable, in order to ensure a smooth movement of the special carrier for erecting beam when the under-bridge position on height is changed; when the erecting trolley moves onto the under-bridge, the erecting trolley is operable to be connected with the leg(s) fixed on a pier using a wirerope, the under-bridge is operable to be driven forward and backward by the erecting trolley through sprocket translation.

The system further comprises a rotatable rear leg connected with and disposed under the under-bridge; the rotatable rear leg and the under-bridge are operable to be on the same line or perpendicular with each other by rotating the rotatable rear leg backward and outward.

The under-bridge further comprises a raising/lowering device, through which a set of the foldable variable position platforms installed on both sides of the under-bridge are elevatable; the foldable and variable position platforms can be folded to be parallel with the both sides respectively, and also can be unfolded to be perpendicular to the both sides respectively.

In this invention, the method for bridge erection using the system of the present invention comprising:

placing a special launching carrier with variable position platform on a first bridge abutment or a bridge deck erected;

regulating the horizontal height of the under-bridge through the height regulating devices disposed on a rotatable rear leg, a front roller, a middle roller and a rear roller;

lowering the rear roller through a leg spreader disposed on front end of the under-bridge and fixing the rear roller on the first bridge abutment or a first bridge pier;

B. driving the under-bridge located on the rear roller forward until the leg spreader reaches a next bridge pier as second bridge pier;

C. placing and fixing the middle roller and the front roller respectively connected with the leg spreader on the second bridge pier;

driving the under-bridge forward and driving the special carrier for erecting beam backward to prefabrication yard to load a bridge beam;

D. driving the erecting trolley disposed on the under-bridge to a position over the middle roller, fixing the erecting trolley to the middle roller with a wirerope, and driving the under-bridge forward through sprocket translation until the leg spreader reaches a next bridge pier as third bridge pier;

E. releasing the fixation of the front roller disposed under the under-bridge, moving the front roller forward along the guider girder to the third bridge pier, and fixing the front roller on the third bridge pier;

releasing the fixation of the middle roller, moving the middle roller to a position on the second bridge pier, where the front roller was placed, and moving the erecting trolley to a position above the middle roller; then fixing the middle roller on the second bridge pier and connecting the middle roller with the erecting trolley using a wirerope;

F. driving the under-bridge forward via sprocket translation, and stopping the under-bridge when the rotatable rear leg disposed at tail portion of the under-bridge is apart from a distance to the first bridge abutment or the bridge deck erected, then operating the rotatable rear leg to be perpendicular to the under-bridge;

G. driving the under-bridge backward in order to form an appropriate space between the under-bridge and the first bridge abutment, making the rotatable rear leg stand on the first bridge abutment, fixing the under-bridge on the first bridge abutment or the bridge deck erected, disconnecting the wirerope from the erecting trolley and then driving the erecting trolley back to the tail portion of the under-bridge;

H. releasing the fixations of the middle roller and the rear roller on the second bridge pier and the first bridge pier respectively, moving the middle roller to the third bridge pier and fixing the same thereon, moving the rear roller to the second bridge pier and fixing the same thereon; unfolding a set of variable position platforms disposed on both sides of tail portion of the under-bridge in order to allow the variable position platforms to be perpendicular to the under-bridge; then regulating the height of the variable position platforms via a raising/lowering device in order to allow the top surface of the platforms to be at the same level with that of a bridge deck; after that, driving the special carrier for erecting beam to the first bridge abutment or the bridge deck erected;

I. regulating the height of the erecting trolley, moving the special carrier for erecting beam carrying a bridge beam towards the erecting trolley, moving partial wheels of a front wheel group smoothly onto the variable position platforms, and stopping the machine from moving when an connecting seat of the machine moves to a position above the erecting trolley; regulating the height of the front wheel group in order to set the connecting seat to the erecting trolley, then lifting the front wheel group up and driving both the machine carrying the bridge beam and the erecting trolley forward until the bridge beam moves to right erection position;

J. releasing the fixation of the under-bridge on the first bridge abutment or the bridge deck erected, braking a rear wheel group of the special carrier for erecting beam; driving the under-bridge forward using the erecting trolley through sprocket translation and allowing tail end of the under-bridge to reach the second bridge pier in order to vacate a position for bridge beam erection;

K. erecting bridge at the position, regulating the horizontal height of the front wheel group to place the front wheel group on the bridge deck erected and the variable position platforms, and driving the special carrier for erecting beam back to prefabrication yard to load a bridge beam for next erection;

L. re-implementing the steps of A-K for erecting next bridge beams except for first and last spans of an entire bridge.

In comparison with the existing special launching carrier with variable position platform, the system of this invention have some advantages as follows:

1. the adaptability of installing a under-bridge is improved, due to the fact that a rotatable rear leg is provided, which can be rotated outward to be on the same line with a under-bridge, and be rotated to be perpendicular with the under-bridge;

2. it may facilitate to erect a bridge deck with a particular size, due to the fact that the height of the under-bridge position can be regulated through a height regulating device installed on each legs.

3. it may improve the stability of erection, the safety of construction, simplify the working procedure, and improve the effectiveness of erection, due to the fact that a set of foldable and elevatable variable position platforms are installed on both sides of tail portion of the under-bridge, which can be perpendicular with the lateral face of the under-bridge and is elevatable to be at the same level as the bridge abutment, so as to allow the front wheel group to move onto the platform smoothly.

The system of this invention may solve the problem with the bridge erection at the entrance and exit of a tunnel or in a tunnel, or the bridge erection between two tunnels in the circumstance that the entire bridge comprises less than three spans. It also help to reasonably shorten the length of the under-bridge by retaining a short distance between the end of the under-bridge and the bridge abutment or the bridge deck erected, so as to improve the load condition of the under-bridge, simplify the procedure, improve the effectiveness of erection, safety and reliability.

The special launching carrier with variable position platform of this invention will be illustrated further with the accompanying drawings.

DETAILED DESCRIPTION OF PREFERRED EMBODIMENTS

Figure 1:
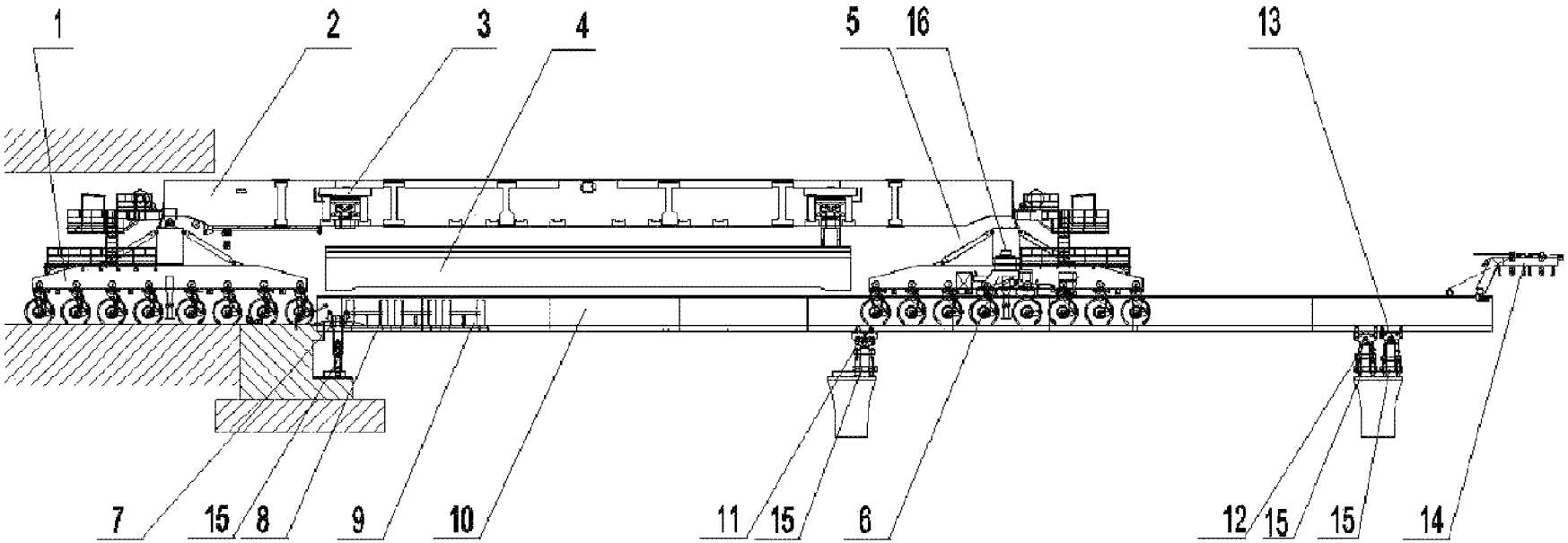
FIG. 1 is a front view of a special launching carrier with variable position platform according to the invention.

Referring to FIG. 1, a special launching carrier with variable position platform according to this invention, comprise a special carrier for erecting beam and an under-bridge machine with platform; the special carrier for erecting beam comprises a main beam 2, a front wheel group 5 and a rear wheel group 1, and the front wheel group 5 and rear wheel group 1 are respectively connected with and disposed under both ends of the main beam 2; a lifting device including a pair of lifting mechanisms 4 are disposed on the main beam 2;

the under-bridge machine with platform comprises a under-bridge 10, a rotatable rear leg 7, a front roller 13, a middle roller 12, a rear roller 11 and an erecting trolley 6; the front roller 13, the middle roller 12 and the rear roller 11 that are disposed for supporting the under-bridge 10 and operable to move along the under-bridge 10 through the rollers; the erecting trolley 6 is disposed on the under-bridge 10; and the rotatable rear leg 7 is connected with and disposed under the under-bridge 10, and the rotatable rear leg 7 and the under-bridge 10 are operable to be on the same line or perpendicular with each other by rotating the rotatable rear leg 7 backward and outward; height regulating devices 15 may be installed on the rotatable rear leg 7, the front roller 13, the middle roller 12 and the rear roller 11 in order to ensure an appropriate horizontal height of the under-bridge 10, and variable position platforms 8 are installed on both sides of the tail portion of the under-bridge 10, which allow the front wheel group 5 to move from bridge abutment or bridge beck onto the under-bridge 10 smoothly.

Figure 2:
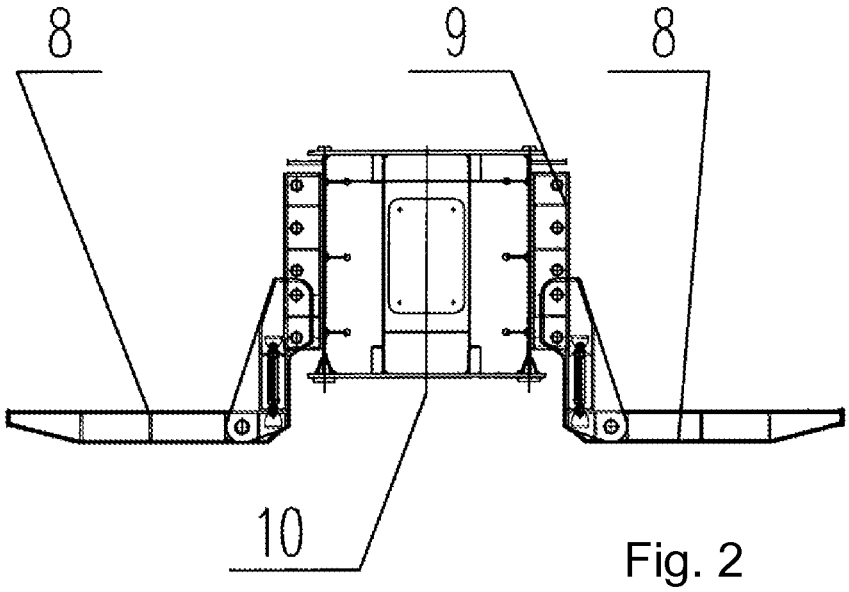
FIG. 2 is a left side view of the unfolded variable position platforms according to the invention.

Referring to FIG. 2, the left side view of under-bridge machine with platform shows unfolded variable position platforms 8, here the top surface of the displacements is at the same level with that of bridge abutment or deck through raising/lowering device 9, and partial wheels of front wheel group 5 move to the variable position platforms smoothly.

Figure 3:
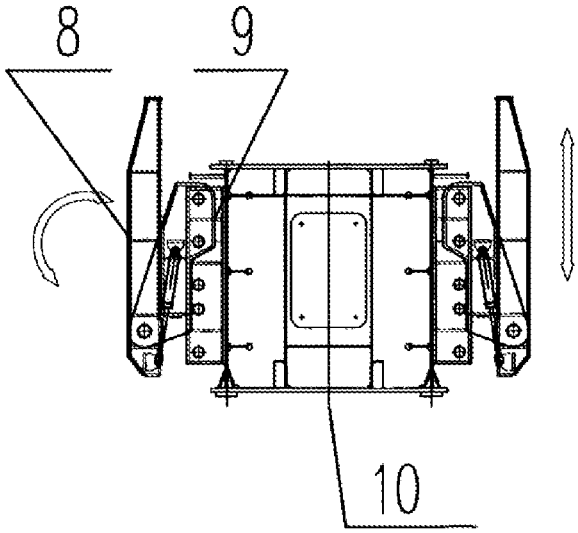
FIG. 3 is a left side view of the folded variable position platforms according to the invention.

Referring to FIG. 3, it shows the left side view of under-bridge machine with platform, of which variable position platforms 8 are folded, and the size of the under-bridge machine with platform may be reduced by folding the platforms 8.

Figure 4:
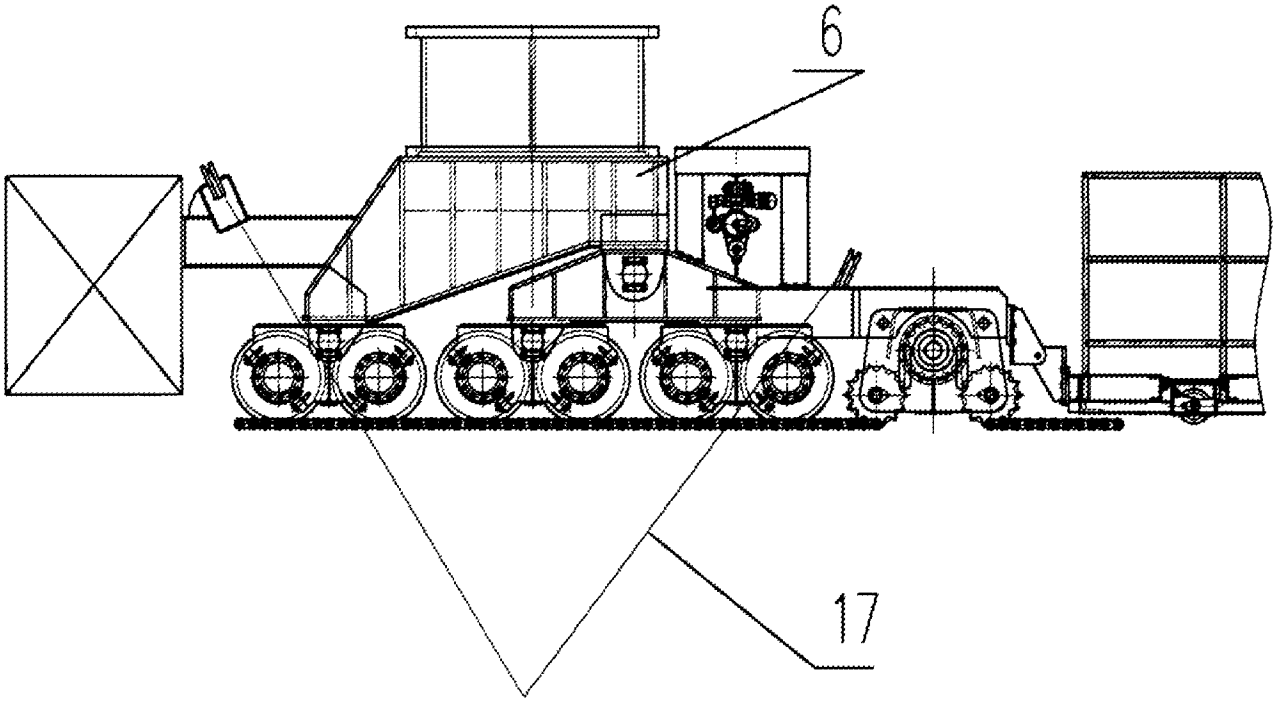
FIG. 4 is a front view of the erecting trolley according to the invention.

Referring to FIG. 4, according to the invention, the erecting trolley 6 may be connected to the special carrier for erecting beam, in order to ensure that the carrying of the front wheel group 5 is transferred to the erecting trolley 6 smoothly.

The height of a connection part of the erecting trolley 6, which is for connecting with the special carrier for erecting beam, is regulatable through the control of the hydraulic system, in order to ensure a smooth movement of the special carrier for erecting beam carrying a bridge beam when the under-bridge position on height is changed.

When the trolley 6 moves onto the under-bridge 10, the trolley 6 is operable to be connected with the leg(s) fixed on a pier using a wirerope, the under-bridge 10 is operable to be driven forward and backward by the trolley 6 through sprocket translation.

The erecting procedure of erection for first bridge deck described as below will be taken as an example of carrying out the erecting method of this invention.

Figure 5:
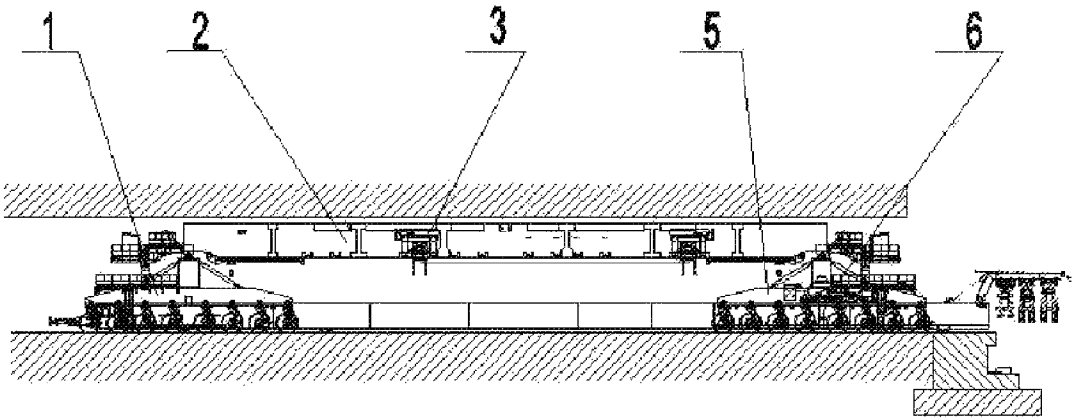
FIG. 5 and FIG. 6 are schematic views showing step 1 of the method for erecting the first span according to the invention.
Figure 6:
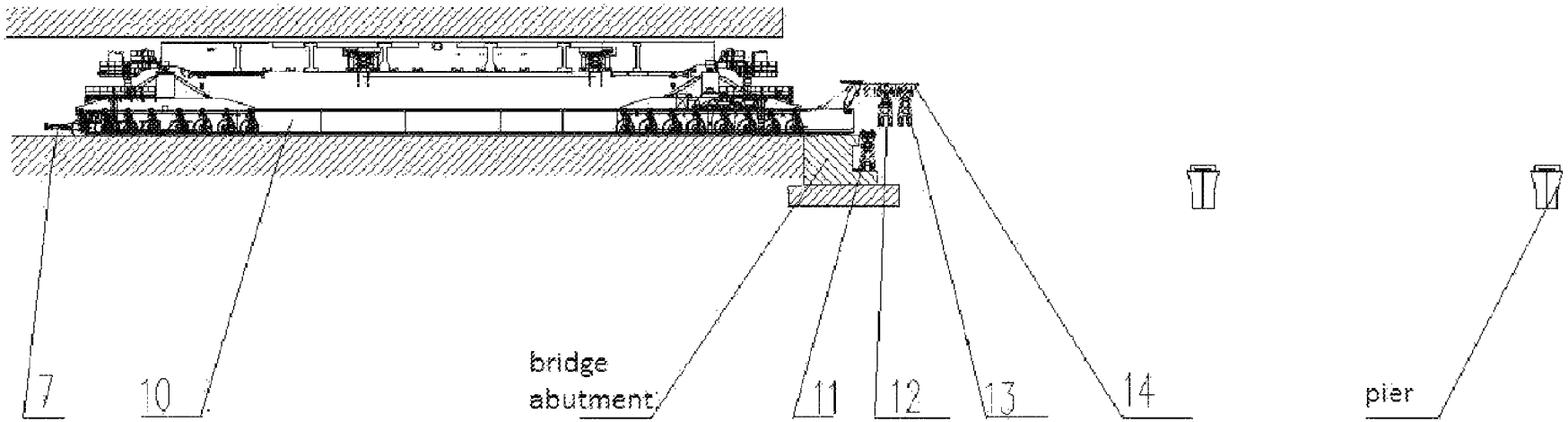
Figure 7:
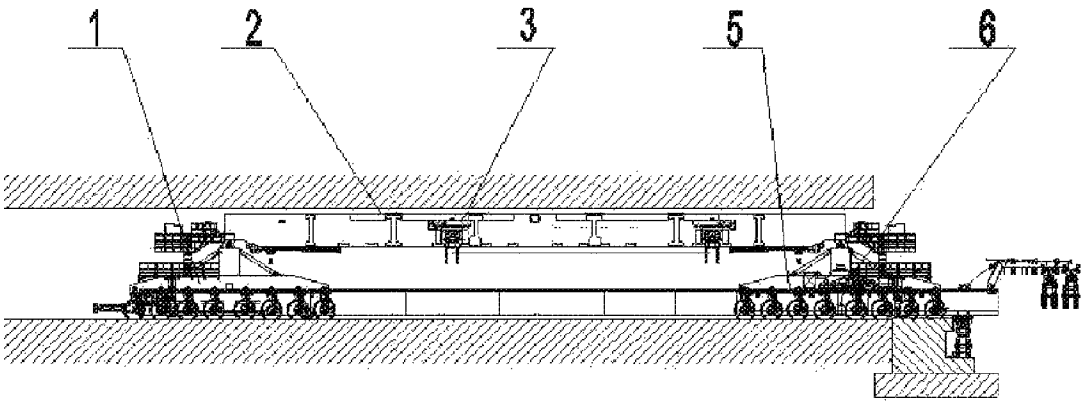
FIG. 7 and FIG. 8 are schematic views showing step 2 of the method for erecting the first span according to the invention.
Figure 8:
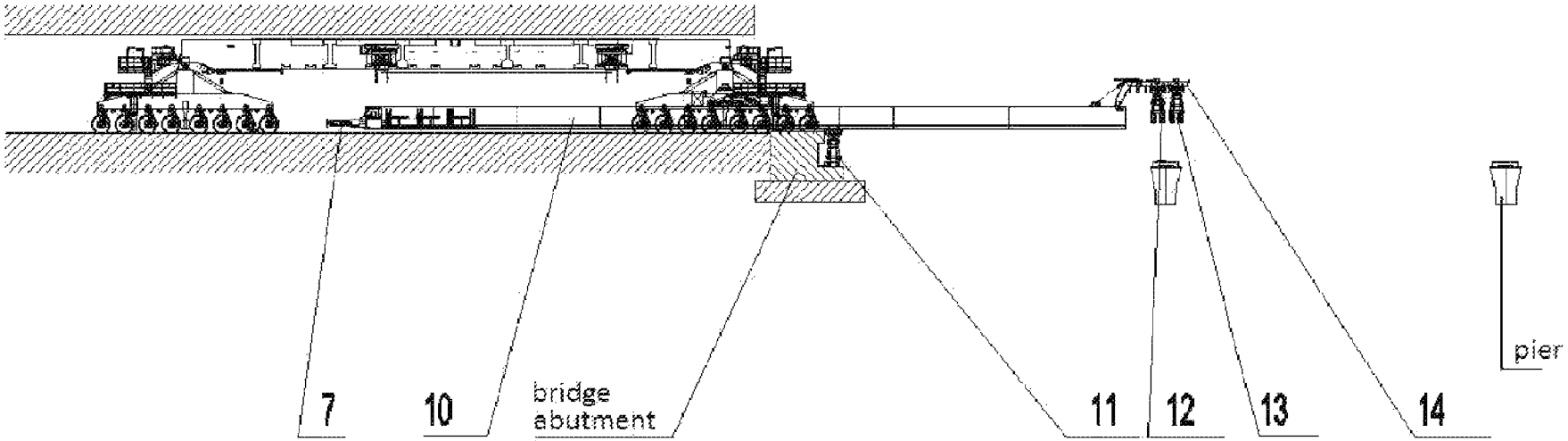
Figure 9:
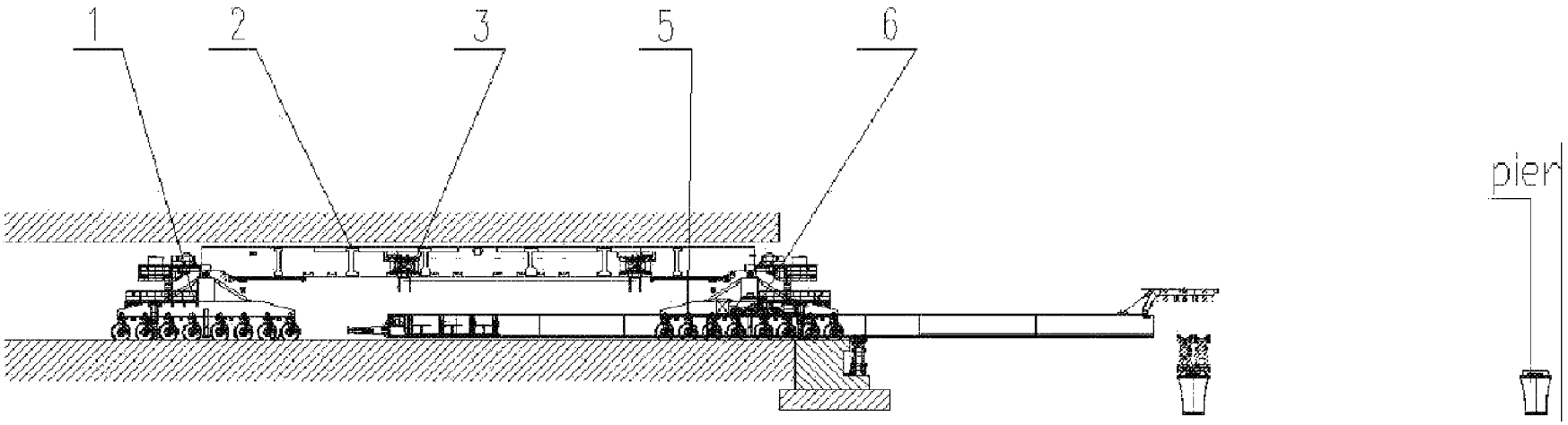
FIG. 9 and FIG. 10 are schematic views showing step 3 of the method for erecting the first span according to the invention.
Figure 10:
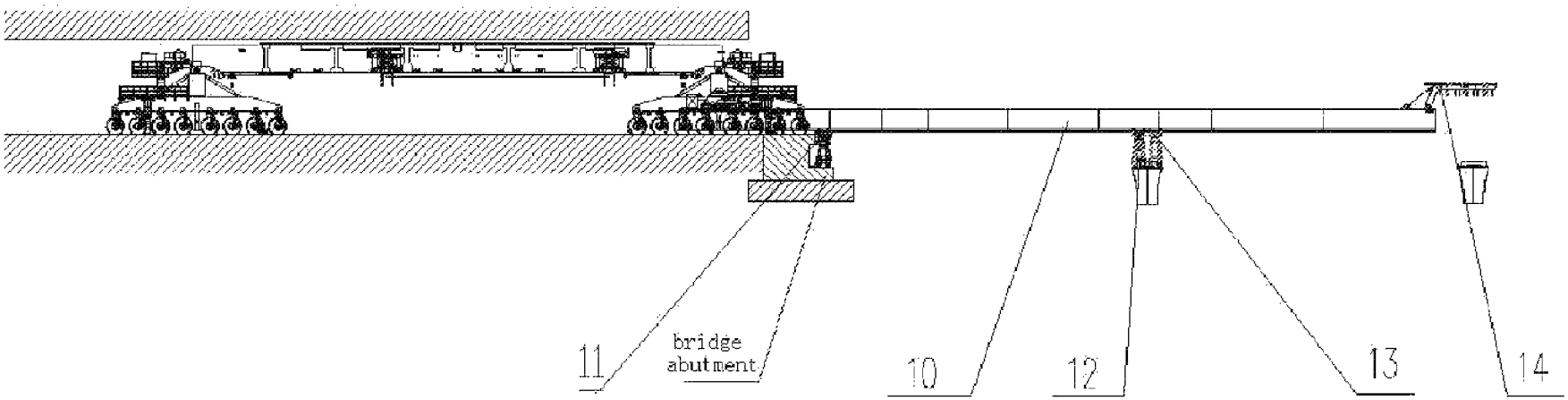
Figure 11:
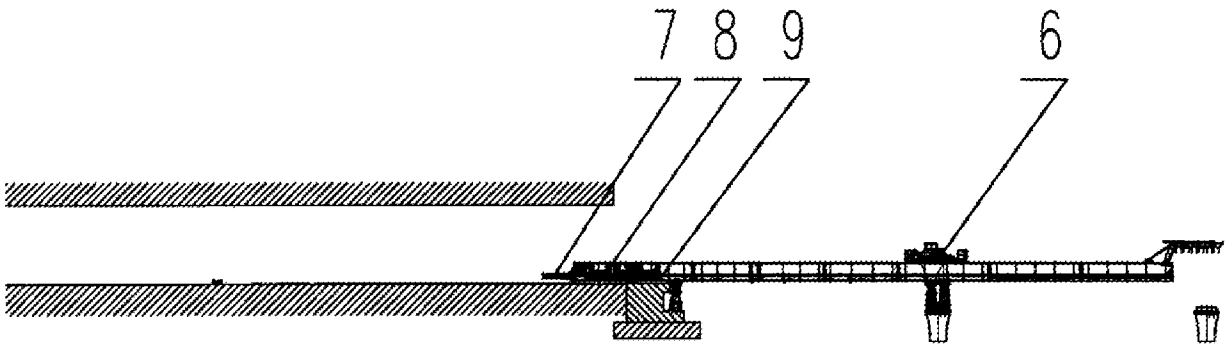
FIG. 11 and FIG. 12 are schematic views showing step 4 of the method for erecting the first span according to the invention.
Figure 12:
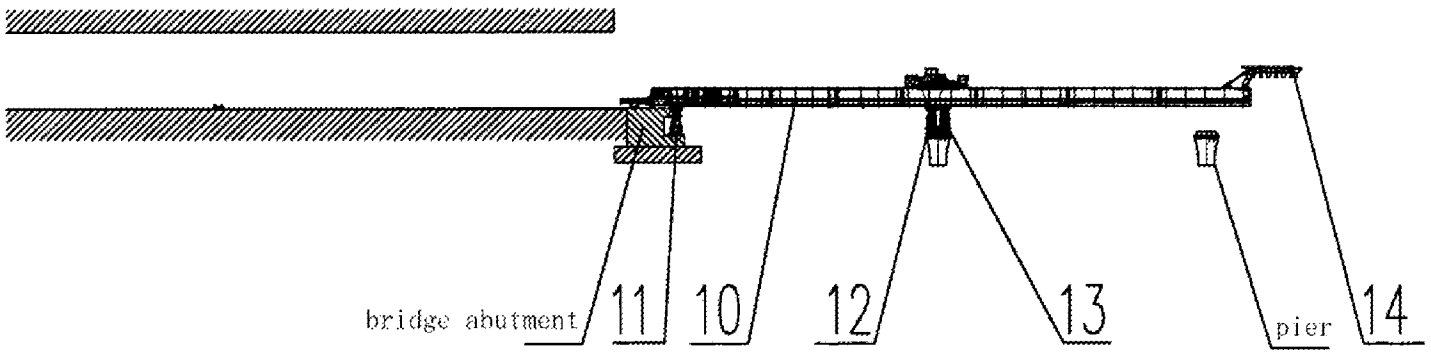
Figures 13, 14:
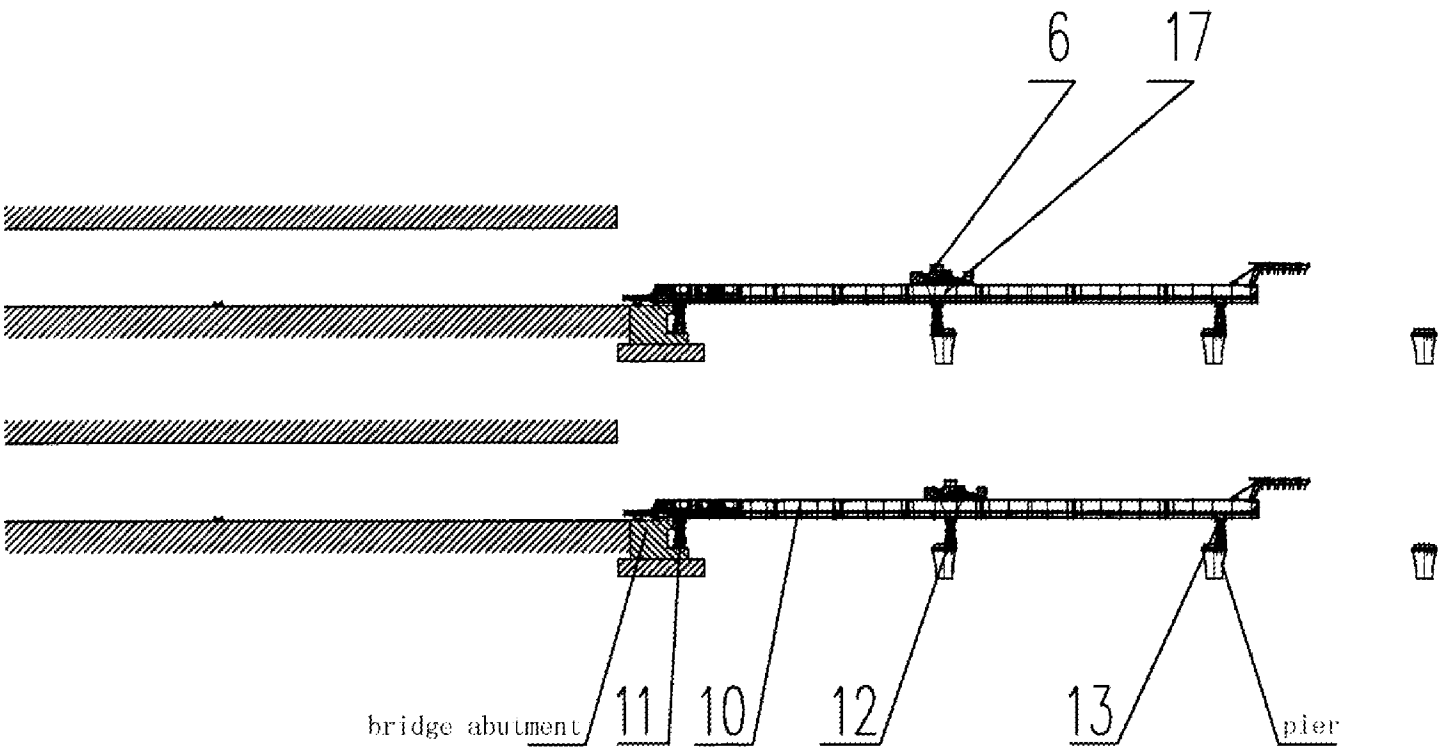
FIG. 13 and FIG. 14 are schematic views showing step 5 of the method for erecting the first span according to the invention.
Figure 15:
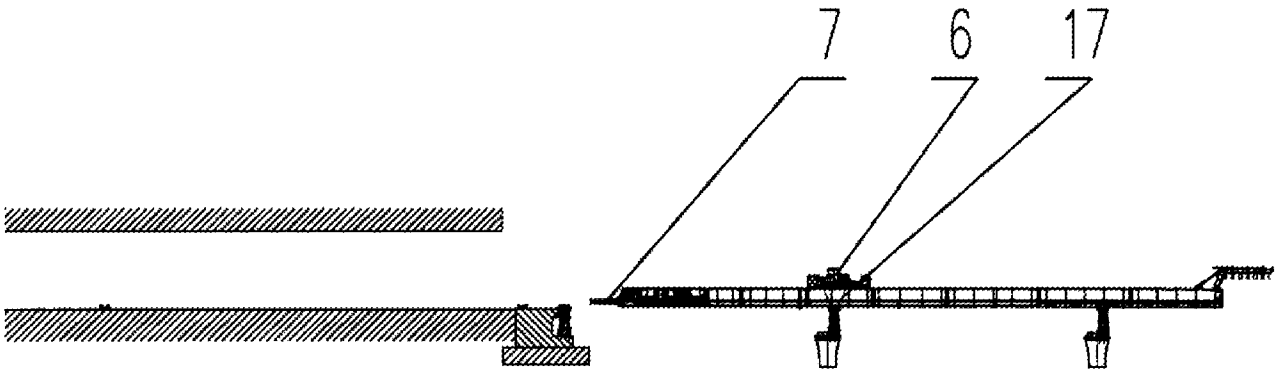
FIG. 15 and FIG. 16 are schematic views showing step 6 of the method for erecting the first span according to the invention.
Figure 16:
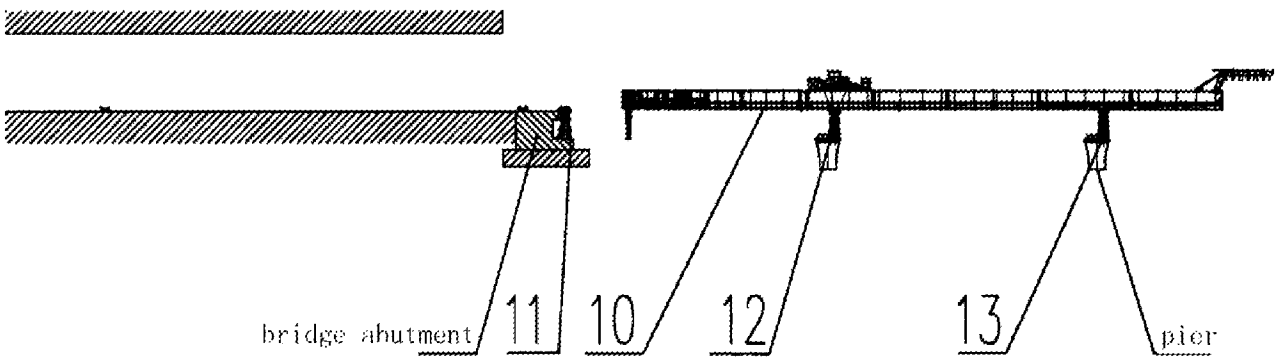
Figures 17, 18:
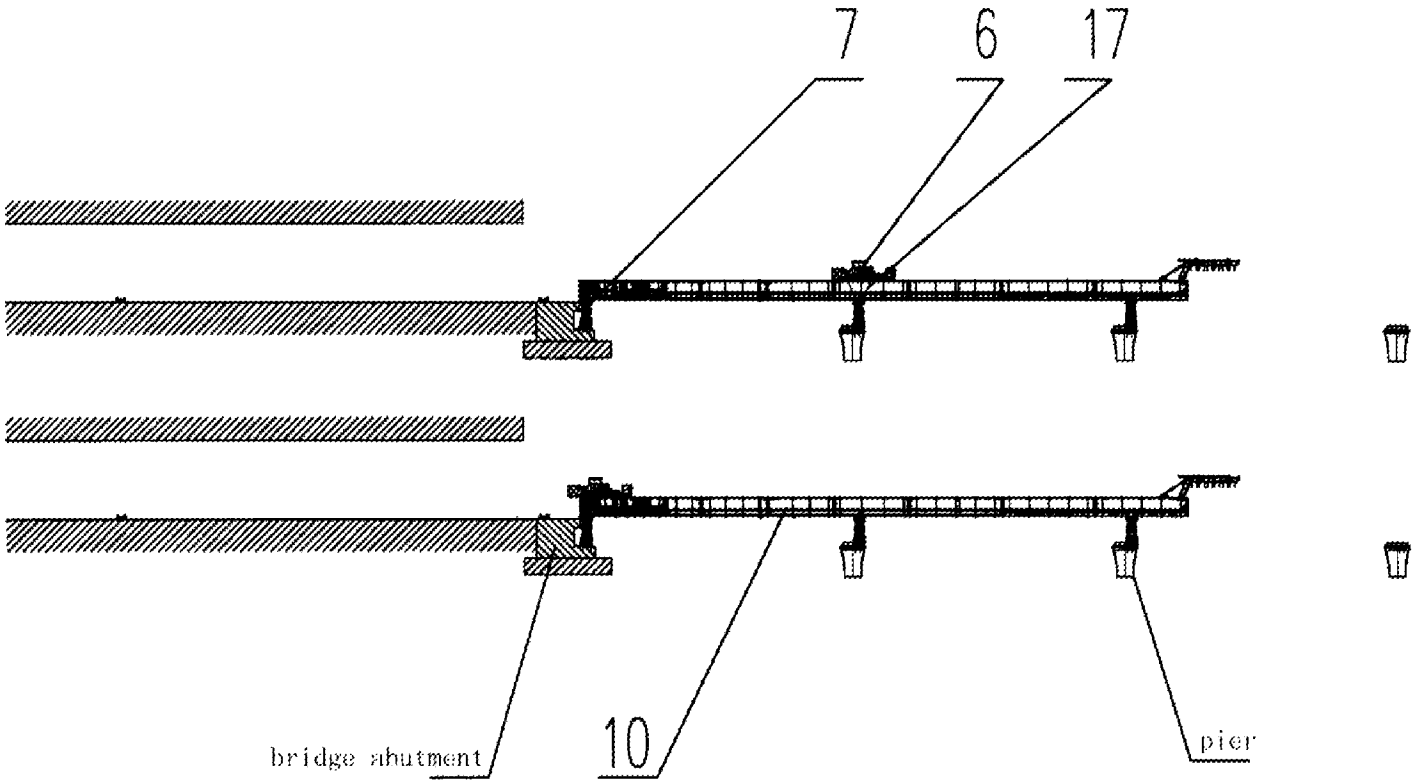
FIG. 17 and FIG. 18 are schematic views showing step 7 of the method for erecting the first span according to the invention.
Figure 19:
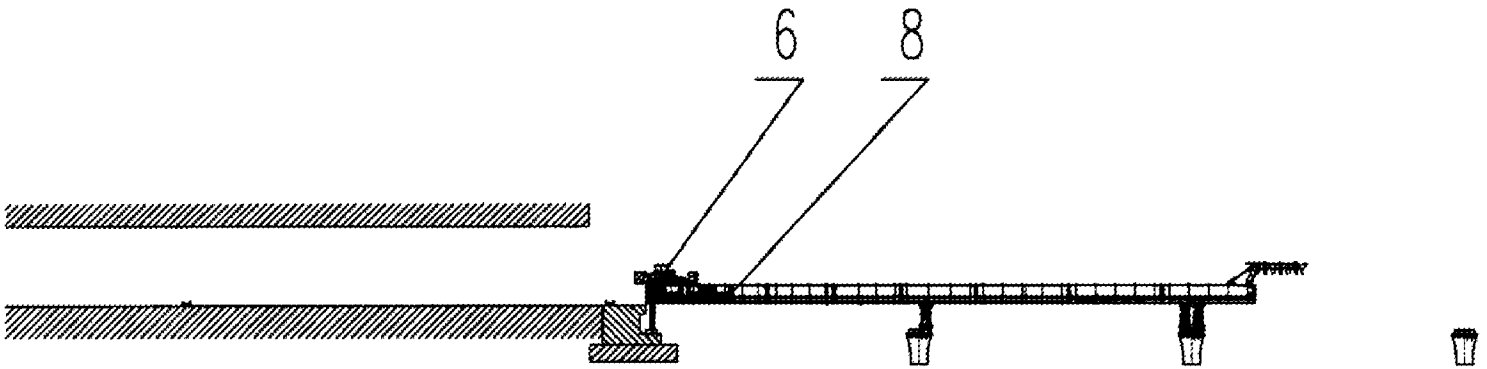
FIG. 19 and FIG. 20 are schematic views showing step 8 of the method for erecting the first span according to the invention.
Figure 20:
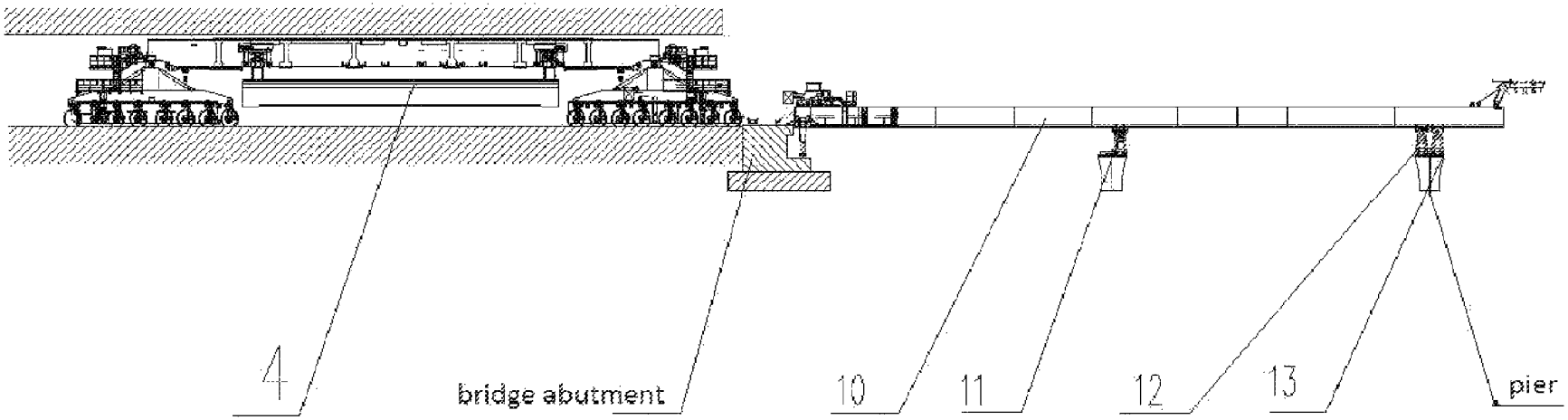
Figure 21:
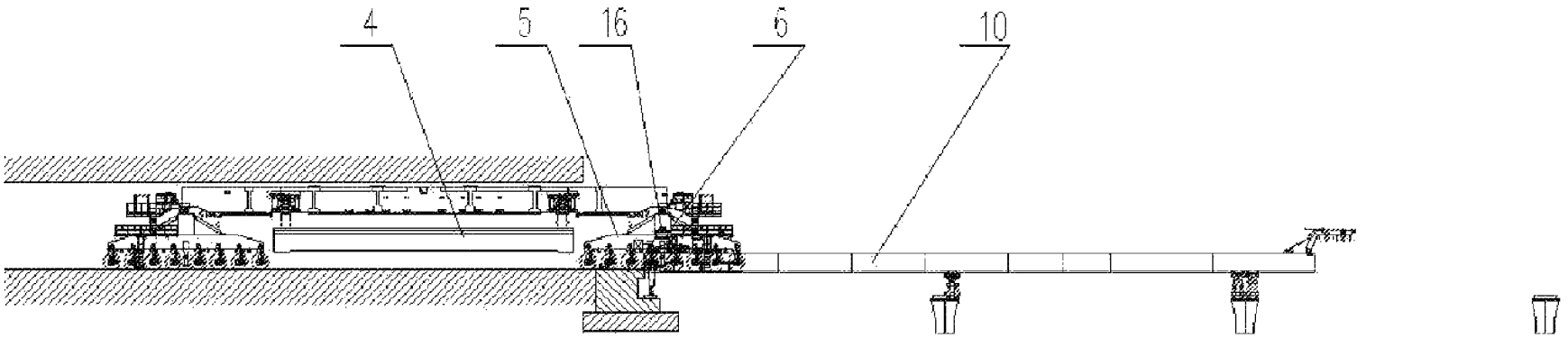
FIG. 21 and FIG. 22 are schematic views showing step 9 of the method for erecting the first span according to the invention.
Figure 22:
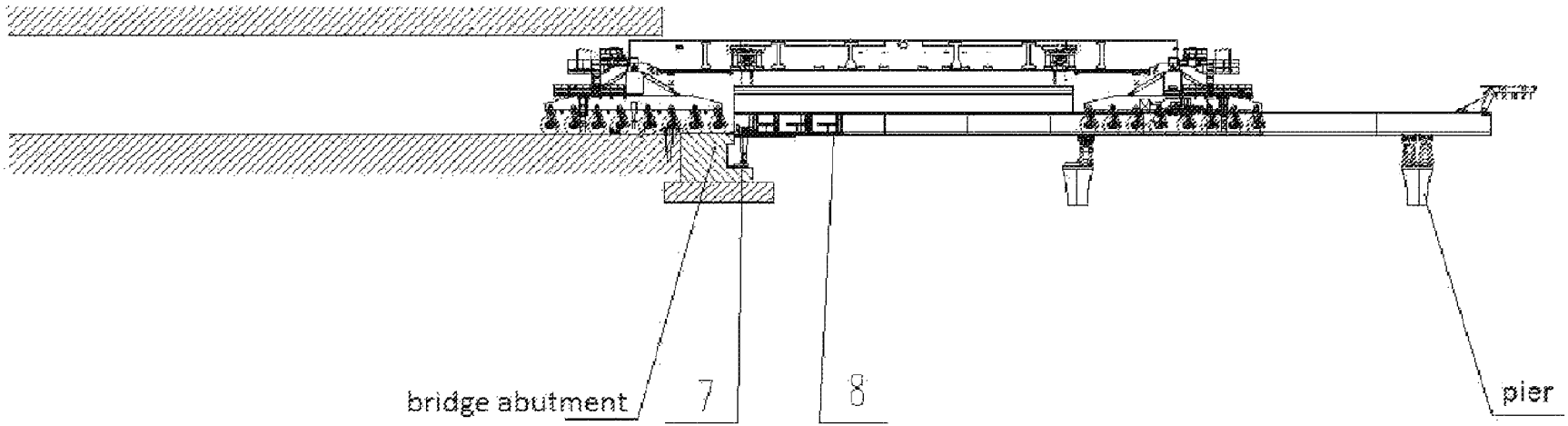
Figure 23:
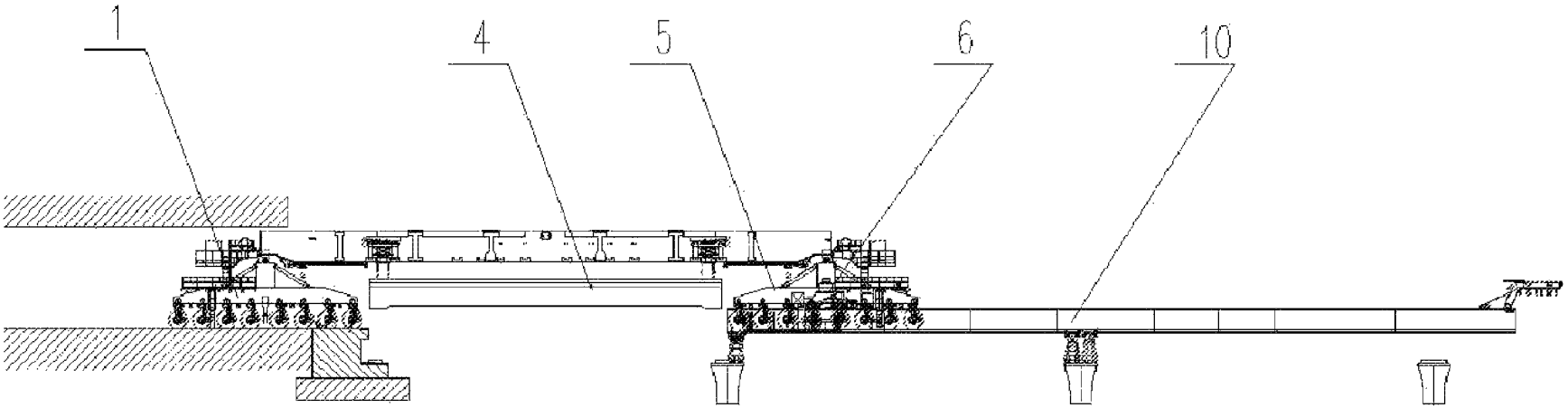
FIG. 23 and FIG. 24 are schematic views showing step 10 of the method for erecting the first span according to the invention.
Figure 24:
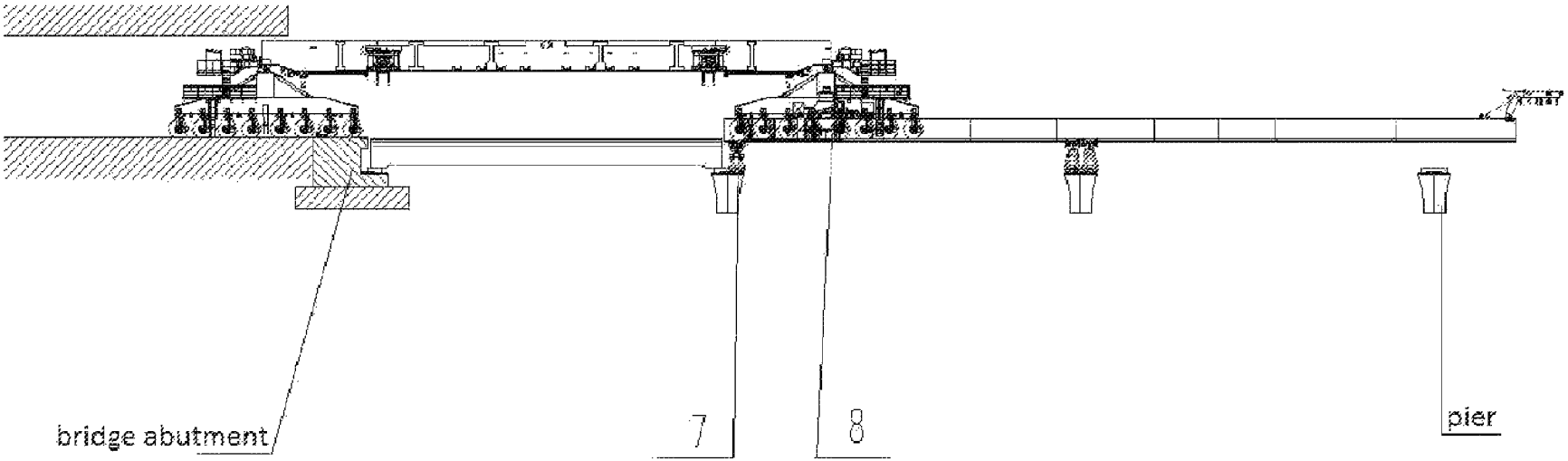

The erecting procedure comprises the following steps:

referring to FIG. 5 and FIG. 6, the first step refers to placing a special launching carrier with variable position platform on a first bridge abutment; regulating the horizontal height of the under-bridge 10 through the height regulating devices 15 disposed on a rotatable rear leg 7, a front roller 13, a middle roller 12 and a rear roller 11; and then lowering the rear roller 11 through a leg spreader 14 disposed on front end of the under-bridge 10 and fixing the rear roller 11 on the first bridge abutment;

and then referring to FIG. 7 and FIG. 8, the second step refers to driving the under-bridge 10 located on the rear roller 11 forward until the leg spreader 14 reaches a next bridge pier as a second bridge pier;

and then referring to FIG. 9 and FIG. 10, the third step refers to placing and fixing the middle roller 12 and the front roller 13 respectively connected with the leg spreader 14 on the second bridge pier; driving the under-bridge 10 forward and driving the special carrier for erecting beam backward to prefabrication yard to load a bridge beam for next erection;

and then referring to FIG. 11 and FIG. 12, the fourth step refers to driving the erecting trolley 6 disposed on the under-bridge 10 to a position over the middle roller 12, fixing the erecting trolley 6 to the middle roller 12 with a wirerope 17, and driving the under-bridge 10 forward through sprocket translation until the leg spreader 14 reaches a next bridge pier as a third bridge pier;

and then referring to FIG. 13 and FIG. 14, the fifth step refers to releasing the fixation of the front roller 13 disposed under the under-bridge 10, moving the front roller 13 forward along the guider girder 10 to the third bridge pier, and fixing the front roller 13 on the third bridge pier; and then releasing the fixation of the middle roller 12, moving the middle roller 12 to a position on the second bridge pier, where the front roller 13 was placed, and moving the erecting trolley 6 to a position above the middle roller 12; then fixing the middle roller 12 on the second bridge pier and connecting the middle roller 12 with the erecting trolley 6 using a wirerope 17;

and then referring to FIG. 15 and FIG. 16, the sixth step refers to driving the under-bridge 10 forward via sprocket translation, and then stopping the under-bridge when the rotatable rear leg 7 disposed at tail portion of the under-bridge 10 is apart from the first bridge abutment a distance, then rotating the rotatable rear leg 7 to allow it to be perpendicular to the under-bridge 10;

and then referring to FIG. 17 and FIG. 18, the seventh step refers to driving the under-bridge 10 backward in order to form an appropriate space between the under-bridge 10 and the first bridge abutment, making the rotatable rear leg 7 stand on the first bridge abutment, fixing the under-bridge 10 on the first bridge abutment, disconnecting the wirerope 17 from the erecting trolley 6 and then driving the erecting trolley back to the tail portion of the under-bridge 10;

and then referring to FIG. 19 and FIG. 20, the eighth step refers to releasing the fixations of the middle roller 12 and the rear roller 11 on the second bridge pier and the first bridge pier or abutment respectively, moving the middle roller 12 to the third bridge pier and fixing the same thereon, moving the rear roller 11 to the second bridge pier and fixing the same thereon; unfolding a set of variable position platforms 8 disposed on both sides of tail portion of the under-bridge 10 in order to allow the variable position platforms to be perpendicular to the under-bridge 10; then regulating the height of the variable position platforms 8 via a raising/lowering device 9 in order to allow the top surface of the platform 8 to be at the same level with that of a bridge deck; after that, driving the special carrier for erecting beam to the first bridge abutment or the bridge deck erected;

and then referring to FIG. 21 and FIG. 22, the ninth step refers to regulating the height of the erecting trolley 6, moving the special carrier for erecting beam carrying a bridge beam towards the erecting trolley 6, moving partial wheels of a front wheel group 5 smoothly onto the variable position platforms 8, and stopping the machine from moving when an connecting seat 16 of the machine moves to a position above the erecting trolley 6; regulating the height of the front wheel group in order to fix the connecting seat 16 to the erecting trolley 6, then lifting the front wheel group up and driving the machine carrying the bridge beam and the erecting trolley 6 forward until the bridge beam moves to an erection position;

Referring to FIG. 23 and FIG. 24, the tenth step refers to releasing the fixation of the under-bridge 10 on the first bridge abutment or the bridge deck erected, braking a rear wheel group 1 of the special carrier for erecting beam; driving the under-bridge forward using the erecting trolley 6 through sprocket translation and allowing tail end of the under-bridge 10 to reach the second bridge pier in order to vacate a position for bridge beam erection and then erecting bridge at the position, regulating the horizontal height of the front wheel group 5 to place the front wheel group 5 on the bridge deck erected and the variable position platforms 8, and driving the special carrier for erecting beam back to prefabrication yard to load a bridge beam.

In normal erecting condition, next bridge decks except for first last bridge span of an entire bridge can be erected by re-implementing the steps 7-10.

While this invention is illustrated by means of a specific embodiment, it is to be understood that numerous changes and modifications may be made therein without departing from the spirit and scope of the invention, as defined in the claims.

The invention claimed is:

1. A special launching carrier with variable position platform, comprising:

a special carrier for erecting beam; and an under-bridge machine with a platform;

wherein, said special carrier for erecting beam comprises a main beam, on which a lifting device is disposed;

front wheel group and a rear wheel group respectively connected with and disposed under said main beam;

said under-bridge machine with the platform comprises a under-bridge, and also comprises a front roller, a middle roller and a rear roller, disposed for supporting said under-bridge and operable to move along said under-bridge through rollers, and further comprises an erecting trolley and a set of foldable and elevatable variable position platforms installed on both sides of tail portion of said under-bridge, which allows said front wheel group to move from bridge abutment or bridge deck onto said under-bridge smoothly;

said system further comprises a rotatable rear leg connected with and disposed under said under-bridge; said rotatable rear leg and said under-bridge are operable to be on the same line or perpendicular with each other by rotating said rotatable rear leg backward and outward; and said rotatable rear leg, said front roller, said middle roller and said rear roller respectively has a height regulating device installed thereon, in order to ensure an appropriate horizontal height of said under-bridge.

2. The system of claim 1, wherein, said horizontal height of said under-bridge is regulated by altering the lengths of said rotatable rear leg, said front roller, said middle roller and said rear roller with said height regulating device.

3. The system of claim 1, wherein, the height of a connection part of said erecting trolley, which is for connecting with said special carrier for erecting beam, is regulatable, in order to ensure a smooth movement of said special carrier for erecting beam when the under-bridge position on height is changed; when said erecting trolley moves onto said under-bridge, said erecting trolley is operable to be connected with said leg(s) fixed on a pier using a wirerope, said under-bridge is operable to be driven forward and backward by said erecting trolley through sprocket translation.

4. The system of claim 1, wherein, said under-bridge further comprises a raising/lowering device, through which a set of said foldable variable position platforms installed on both sides of said under-bridge are elevatable; said foldable and elevatable variable position platforms can be folded to be parallel with said both sides respectively, and also can be unfolded to be perpendicular to said both sides respectively.

5. The system of claim 2, wherein, the height of a connection part of said erecting trolley, which is for connecting with said special carrier for erecting beam, is regulatable, in order to ensure a smooth movement of said special carrier for erecting beam when the under-bridge position on height is changed; when said erecting trolley moves onto said under-bridge, said erecting trolley is operable to be connected with said leg(s) fixed on a pier using a wirerope, said under-bridge is operable to be driven forward and backward by said erecting trolley through sprocket translation.

6. The system of claim 2, wherein, said under-bridge further comprises a raising/lowering device, through which a set of said foldable variable position platforms installed on both sides of said under-bridge are elevatable; said foldable and elevatable variable position platforms can be folded to be parallel with said both sides respectively, and also can be unfolded to be perpendicular to said both sides respectively.

7. A method for bridge erection using the system of claim 1, comprising the steps of:

placing a special launching carrier with variable position platform on a first bridge abutment or a bridge deck erected;

regulating the horizontal height of said under-bridge through said height regulating devices disposed on a rotatable rear leg, a front roller, a middle roller and a rear roller;

lowering said rear roller through a leg spreader disposed on front end of said under-bridge and fixing said rear roller on said first bridge abutment or a bridge pier;

driving said under-bridge located on said rear roller forward until said leg spreader reaches a next bridge pier as second bridge pier;

placing and fixing said middle roller and said front roller respectively connected with said leg spreader on said second bridge pier;

driving said under-bridge forward and driving said special carrier for erecting beam backward to prefabrication yard to load a bridge beam;

driving said erecting trolley disposed on said under-bridge to a position over said middle roller, fixing said erecting trolley to said middle roller with a wirerope, and driving said under-bridge forward through sprocket translation until said leg spreader reaches a next bridge pier as third bridge pier;

releasing the fixation of said front roller disposed under said under-bridge, moving said front roller forward along said under-bridge to said third bridge pier, and fixing said front roller on said third bridge pier;

releasing the fixation of said middle roller, moving said middle roller to a position on said second bridge pier, where said front roller was placed, and moving said erecting trolley to a position above said middle roller;

then fixing said middle roller on said second bridge pier and connecting said middle roller with said erecting trolley using a wirerope;

driving said under-bridge forward via sprocket translation, and stopping said under-bridge when said rotatable rear leg disposed at tail portion of said under-bridge is apart from a distance to said first bridge abutment or said bridge deck erected, then rotating said rotatable rear leg to be perpendicular to said under-bridge;

driving said under-bridge backward in order to form an appropriate space between said under-bridge and said first bridge abutment, making said rotatable rear leg stand on said first bridge abutment, fixing said under-bridge on said first bridge abutment or said bridge deck erected, disconnecting said wirerope from said erecting trolley and then driving said erecting trolley back to the tail portion of said under-bridge;

releasing the fixations of said middle roller and said rear roller on said second bridge pier and said first bridge pier or abutment respectively, moving said middle roller to said third bridge pier and fixing the same thereon, moving said rear roller to said second bridge pier and fixing the same thereon; unfolding a set of variable position platforms disposed on both sides of tail portion of said under-bridge in order to allow said variable position platforms to be perpendicular to said under-bridge; then regulating the height of said variable position platforms via a raising/lowering device in order to allow the top surface of said platforms to be at the same level with that of a bridge deck; after that, driving said special carrier for erecting beam to said first bridge abutment or said bridge deck erected;

regulating the height of said erecting trolley, moving said special carrier for erecting beam carrying a bridge beam towards said erecting trolley, moving partial wheels of a front wheel group smoothly onto said variable position platforms, and stopping said machine from moving when an connecting seat of said machine moves to a position above said erecting trolley; regulating the height of said front wheel group in order to set said connecting seat to said erecting trolley, then lifting said front wheel group up and driving both said machine carrying said bridge beam and said erecting trolley forward until said bridge beam moves to right erection position;

releasing the fixation of said under-bridge on said first bridge abutment or said bridge deck erected, braking a rear wheel group of said special carrier for erecting beam; driving said under-bridge forward using said erecting trolley through said sprocket translation and allowing tail end of said under-bridge to reach said second bridge pier in order to vacate a position for bridge beam erection;

erecting bridge at said position, regulating the horizontal height of said front wheel group to place said front wheel group on said bridge deck erected and said variable position platforms, and driving said special carrier for erecting beam back to prefabrication yard to load a bridge beam for next erection;

re-implementing the steps of A-K for erecting next bridge beams except for first and last spans of an entire bridge.

* * * * *